US005669324A

United States Patent [19]

Muir, III

[11] Patent Number: 5,669,324

[45] Date of Patent: Sep. 23, 1997

[54] ROLLING CHAIR FRAME

[76] Inventor: Robert C. Muir, III, 2270 Hillcrest Rd., Quakertown, Pa. 18951

[21] Appl. No.: 676,984

[22] Filed: Jul. 8, 1996

[51] Int. Cl.[6] ..... B63B 29/04

[52] U.S. Cl. ..... 114/194; 297/216.19

[58] Field of Search ..... 114/191–195; 297/216.19; 244/122 R

[56] References Cited

U.S. PATENT DOCUMENTS

| | | | |
|---|---|---|---|
| 12,703 | 4/1855 | Thomas . | |
| 224,232 | 2/1880 | Schrader | 114/192 |
| 968,195 | 8/1910 | Reed . | |
| 2,195,428 | 4/1940 | Searing | 114/191 |
| 2,770,286 | 11/1956 | Weller | 155/5 |
| 4,254,990 | 3/1981 | Kelley | 297/273 |
| 4,425,863 | 1/1984 | Cutler | 114/363 |
| 5,119,754 | 6/1992 | Martinez et al. | 114/363 |

*Primary Examiner*—Jesus D. Sotelo
*Attorney, Agent, or Firm*—Richard L. Miller, P.E.

[57] ABSTRACT

A rolling chair frame that includes a one-piece tubular frame, a platform, movable mounting apparatus, and preventing apparatus. The one-piece tubular frame is attachable to a movable object. The platform is sidewardly movably mounted to the one-piece tubular frame and is adapted to replaceably receive a chair. The movable mounting apparatus sidewardly movably mounts the platform to the one-piece tubular frame and maintains the platform level as the movable object moves. And, the preventing apparatus prevents removal of the platform from the one-piece tubular frame, so that the platform cannot be unintentionally removed from the one-piece tubular frame.

25 Claims, 3 Drawing Sheets

ROLLING CHAIR FRAME

CROSS REFERENCE TO RELATED APPLICATIONS

This application is a refine of application Ser. No. 08/201,387 filed Feb. 24, 1994, now abandoned.

BACKGROUND OF THE INVENTION

The present invention relates to a rolling chair frame. More particularly, the present invention relates to a rolling chair frame that includes a one-piece tubular frame that is attachable to a movable object, a platform that is sidwardly movably mounted to the one-piece tubular frame, preventing apparatus for preventing the unintentional removal of the platform from the one-piece tubular frame, and movable mounting apparatus for sidwardly movably mounting the platform to the one-piece tubular frame and for maintaining the platform level as the movable object moves.

The nature of a mono hull sailboat is that it leans over or heels at substantial degrees of angle while under sail. This leaning or heeling action is a result of the rolling side to side or oscillating motion inherent in the movement of a ship or sailboat through the water, particularly but not limited to, being under sail power.

The helmsman, who is the person who steers the sailboat, is forced to sit at uncomfortable angles as the traditional stationary helmsman seat heels at the same degree of angle as the sailboat heels.

Some sailboats have stationary convex or concave seats either built in or as a fixture on the boat or as an accessory added to the boat. The helmsman can adjust to the varying degrees of heel only by constantly repositioning his body physically on seats of these designs as they constantly change degrees of angle with the heel of the boat.

These designs by the nature of their shape do not fit the contour of the human anatomy and are therefore uncomfortable for prolonged periods of time. Sailboats are not fast and trips lasting many hours, days, weeks, or months are not unusual. Because these designs fail to provide comfort for the helmsman, the helmsman often is forced to stand up with one foot braced in such a fashion as to keep himself upright for prolonged periods of time as the sailboat heels over. This position is both tiring and dangerous.

Past attempts to address this problem have not provided a solution that is economical and practical, but rather have produced solutions that are cumbersome, expensive, and unadaptable to use on the deck of a sailboat. These previously known forms of chairs or seats do not provide a simple and affordable adaptation to a sailboat.

Numerous innovations for stabilizing chairs have been provided in the prior art that will be described. Even though these innovations may be suitable for the specific individual purposes to which they address, however, they differ from the present invention in that they do not teach a rolling chair frame that includes a one-piece tubular frame that is attachable to a movable object, a platform that is sidwardly movably mounted to the one-piece tubular frame, preventing apparatus for preventing the unintentional removal of the platform from the one-piece tubular frame, and movable mounting apparatus for sidwardly movably mounting the platform to the one-piece tubular frame and for maintaining the platform level as the movable object moves.

FOR EXAMPLE, U.S. Pat. No. 12,703 to Thomas teaches a cabin chair that includes a seat placed within a frame which is attached by pivots to the body of the chair. The seat has friction rollers or wheels attached to its underside which work upon the lower curved portion of the frame whereby the frame and body of the chair are allowed to turn or be inclined in accordance with the motions of the vessel and the seat at the same time always remaining in a horizontal position.

The cabin chair of Thomas achieves a gimbal function with the feature of counteracting the pitch or fore and aft movement of a boat. It employs a substantially different design than the present invention, however, by using a complete chair hung from pivotal yokes and parts that would interfere with the free movement of the user upon heeling over. Adaptation to the confined space on a sailboat is a distinct problem.

ANOTHER EXAMPLE, U.S. Pat. No. 968,195 to Reed teaches a chair that includes a supporting base, and a frame revolvably mounted thereon. The frame includes an upright U-shaped member with its intermediate portion fixed to the base and has a substantially circular chair receiving member arranged at right angles and fixed to the free ends of the U-shaped member. A series of open rings are arranged in the upper circular member of the supporting frame. Means is provided to pivotally connect one of the rings with the circular member of the frame. Means is provided to connect the other ring with the first mentioned ring at right angles to the pivotal connection of the latter with the frame. A chair is arranged in the rings and adjustable means is provided to hold the chair in a tilted position.

The chair of Reed achieves a gimbal function with the feature of counteracting the pitch or fore—aft movement of the boat. It employs an entirely different design than the present invention, however, by using common gimbal technology known in the art and parts that would interfere with the free movement of the user upon heeling over. Adaptation to the confined space on a sailboat is a distinct problem.

STILL ANOTHER EXAMPLE, U.S. Pat. No. 2,195,428 to Searing teaches a stabilizing platform that includes superpose frames each formed to provide pairs of oppositely disposed arcuate tracks of equal radius on the upper surface thereof. One track of each pair formed by a smaller segment of arc than the other track of the pair. Pairs of axle means are rigidly mounted on the frames the axles of each pair being spaced apart. Wheel means on the axles rotatable engage the tracks. The wheels of each pair of wheels on each track of lesser segment are mounted closer together than the wheels on the other track the pair of tracks.

YET ANOTHER EXAMPLE, U.S. Pat. No. 2,770,286 to Weller teaches a self-leveling seat structure that includes a posterior-receiving seat member, guide rail means extending transversely of the front to rear direction of the seat member, and roller support means cooperative with the guide rail means for supporting the member for movement in the transverse direction relative to the support for the assembly along an arc of a circle in response to changes in angularity of the support relative to the horizontal, and means engaging the guide rails for limiting the freedom of adjustment in response to the changes.

STILL YET ANOTHER EXAMPLE, U.S. Pat. No. 4,254,990 to Kelley teaches a stabilized oscillating chair that includes base means, a column extending upwardly from the base, a seat assembly having a bottom, a back, and arm rest portions, and a yoke assembly supported on the upper portion of the column for roll rotation.

The stabilized oscillating chair of Kelley achieves a gimbal function with the feature of counteracting the pitch or fore—aft aft movement of the boat. It employs an entirely different design than the present invention, however, by using pivotal yokes and springs. It would be difficult to fit in the often confining space of a sailboat cockpit or cabin and the spring design would inhibit the chair from leveling at the large degree of heel experienced on a sailboat.

YET STILL ANOTHER EXAMPLE, U.S. Pat. No. 4,425,863 to Cutler teaches a pendulum helmsman seat that includes a base portion and a rudder control member oscillatable about a first fore and aft extending horizontal axis. A mount portion is supported from the base portion for adjustable vertical shifting relative thereto and a seat structure is oscillatably supported from the mount portion in pendulum fashion for swinging about a second fore and aft axis disposed at least generally in the same vertical plane and the mount portion being vertically adjustable relative to the first axis.

The pendulum helmsman seat of Cutler addresses the rolling motion of a sailboat. It is, however, a large and intricate apparatus using a pedestal. It would require a substantial substructure on the boat to offer support and would be unadaptable to most sailboats as a result of the space requirements as well.

FINALLY, STILL YET ANOTHER EXAMPLE, U.S. Pat. No. 5,119,754 to Martinez et al. teaches a boat seat stabilizing apparatus that includes a support column having a base fixedly attachable to the deck of a boat, A first support arm having a front portion pivotally attached to the support column in a manner to remain about horizontal, A second support arm having an upper portion pivotally attached to the first support arm in a manner to remain about vertical, and a chair mounting post, a pitch guard mechanism operatively connected to the first support arm and the support column, and a roller guard mechanism operatively connected to the second support arm and the first support arm.

The boat seat stabilizing apparatus of Martinez et al. achieves a gimbal function with the feature of counteracting the pitch or fore and aft movement of a boat. It employs a substantially different design than the present invention, however, and parts that would interfere with the free movement of the user upon heeling over. Adaptation to the confined space on a sailboat is a distinct problem.

It is apparent that numerous innovations for stabilizing chair have been provided in the prior art that are adapted to be used. Furthermore, even though these innovations may be suitable for the specific individual purposes to which they address, they would not be suitable for the purposes of the present invention as heretofore described.

Publications, in applicant's knowledge, that reference boat equipment include:

1. Boat U.S. Catalog, 1994, Boat/US Marine Centers, Washington National Headquarters, 880 S. Pickett Street, Alexandria, Va. 22304;
2. West Marine Catalog, 1993, West Marine, 500 Westbridge Drive, Watsonville, Calif. 95076;
3. M&E Catalog, M&E Marine Supply Co., PO Box 601, Camden, N.J. 08101;
4. E&B Catalog, 1993, E&B Discount Marine, 201 Meadow Road, Edison, N.J. 08818-3138; and
5. Edson Catalog K-24A, The Edson Corporation, 146 Duchaine Blvd., New Bedford, Mass. 02745-1292.

SUMMARY OF THE INVENTION

Applicant has provided a device upon which a chair or seat can be mounted on a sailboat and remain level, i.e. a rolling chair frame upon which a comfortable chair or seat can be mounted or installed which will allow the chair or seat to oscillate and remain level as the boat upon which it is mounted rolls with the sea and heels under the power of sail.

The present invention allows any type of object, chair or seat of the user's choice to be mounted thereon, ranging from the most comfortable arm chair with foot rest and arm rests to a simple frame to hold a removable cushion as a seat, so that the user can afford the present invention and make it as comfortable as the user chooses.

A sailboat should not have to be altered, or structurally strengthened to accept the present invention which in fact affords simplicity of operation, lightness of weight, few moving parts, mobility, ease of installation, ease of adaptation, ease of removal, which are some characteristics, inter alia, that substantially improve the function, comfort, and use of a chair or seat on a sailboat, and thereby solve the problems that have been unsolved by the prior art.

ACCORDINGLY, AN OBJECT of the present invention is to provide a rolling chair frame that avoids the disadvantages of the prior art.

ANOTHER OBJECT of the present invention is to provide a rolling chair frame that is simple and inexpensive to manufacture.

STILL ANOTHER OBJECT of the present invention is to provide a rolling chair frame that is simple to use.

YET ANOTHER OBJECT of the present invention is to provide a rolling chair frame that uses an entirely new and unique design which is adaptable to sailboats without substantial reinforcement or alteration to the structure of the sailboat and within the limited space available on such a sailing vessel.

STILL YET ANOTHER OBJECT of the present invention is to provide a rolling chair frame that uses an entirely new and unique design that adds features of simplicity, sturdiness, and lightness of weight.

YET STILL ANOTHER OBJECT of the present invention is to provide a rolling chair frame that is functionally easier to adapt to a sailboat.

STILL YET ANOTHER OBJECT of the present invention is to provide a rolling chair frame that adapts to the rolling and heeling motion of a ship or sailboat.

YET STILL ANOTHER OBJECT of the present invention is to provide a rolling chair frame that allows for choice of seat and thereby allows comfortable chairs of choice.

STILL YET ANOTHER OBJECT of the present invention is to provide a rolling chair frame that dampens oscillating motion.

YET STILL ANOTHER OBJECT of the present invention is to provide a rolling chair frame that is easy to install using a variety of existing means for mounting on to a sailboat, so that it can be installed more easily on new and old sailboats of different designs and shapes while allowing the installation to be of a permanent nature, removable, or mobile to accommodate the user's needs.

STILL YET ANOTHER OBJECT of the present invention is to provide a rolling chair frame that is easy to remove and disassemble for cleaning and storage and for access to other areas of a sailboat.

YET STILL ANOTHER OBJECT of the present invention is to provide a rolling chair frame that is easy to store.

STILL YET ANOTHER OBJECT of the present invention is to provide a rolling chair frame that is easy to move.

YET STILL ANOTHER OBJECT of the present invention is to provide a rolling chair frame that is easily adaptable to current day sailing crafts and modern boats without altering the boat.

STILL YET ANOTHER OBJECT of the present invention is to provide a rolling chair frame that is adaptable to any other devices or equipment that has a rolling motion, thus allowing it to be used on devices or equipment other than a sailboat.

YET STILL ANOTHER OBJECT of the present invention is to provide a rolling chair frame that is constructed of components that can withstand the rigors of a marine environment.

STILL YET ANOTHER OBJECT of the present invention is to provide a rolling chair frame that allows a chair that is mounted thereon to always remain level as the boat heels at any degree of angle, thus providing the helmsman with a comfortable place to sit for prolonged periods of time, so that the helmsman can enjoy boating in the comfort reserved for operators of power boats.

BRIEFLY STATED, YET STILL ANOTHER OBJECT of the present invention is to provide a rolling chair frame that includes a one-piece tubular frame, a platform, movable mounting apparatus, and preventing apparatus.

STILL YET ANOTHER OBJECT of the present invention is to provide a rolling chair frame wherein the one-piece tubular frame is attachable to a movable object.

YET STILL ANOTHER OBJECT of the present invention is to provide a rolling chair frame wherein the platform is sidewardly movably mounted to the one-piece tubular frame and is adapted to replaceably receive a chair.

STILL YET ANOTHER OBJECT of the present invention is to provide a rolling chair frame wherein the movable mounting apparatus sidewardly movably mounts the platform to the one-piece tubular frame and maintains the platform level as the movable object moves.

YET STILL ANOTHER OBJECT of the present invention is to provide a rolling chair frame wherein the preventing apparatus prevents removal of the platform from the one-piece tubular frame, so that the platform cannot be unintentionally removed from the one-piece tubular frame.

STILL YET ANOTHER OBJECT of the present invention is to provide a rolling chair frame wherein the one-piece tubular frame has a pair of tubular, parallel, spaced-apart, and substantially U-shaped concavo-convex tracks that are connected to each other, at ends thereof, by a pair of tubular, parallel, and spaced-apart transverse members.

YET STILL ANOTHER OBJECT of the present invention is to provide a rolling chair frame wherein each track of the pair of tubular, parallel, spaced-apart, and substantially U-shaped concavo-convex tracks of the one-piece tubular frame has a concave-shaped upper surface, and a convex-shaped lower surface that is parallel to, and disposed below, the concave-shaped upper surface of the pair of tubular, parallel, spaced-apart, and substantially U-shaped concave-shaped tracks of the one-piece tubular frame.

STILL YET ANOTHER OBJECT of the present invention is to provide a rolling chair frame wherein the one-piece tubular frame further has two pair of tubular, spaced-apart, and downwardly-outwardly-slanting upper leg portions.

YET STILL ANOTHER OBJECT of the present invention is to provide a rolling chair frame wherein each pair of the two pair of tubular, spaced-apart, and downwardly-outwardly-slanting upper leg portions of the one-piece tubular frame slant downwardly and outwardly, in a straight line, from the lower surface of each track of the pair of tubular, parallel, spaced-apart, and substantially U-shaped concave-shaped tracks of the one-piece tubular frame, inboard of the ends thereof so as to accommodate for different shapes and designs of the object.

STILL YET ANOTHER OBJECT of the present invention is to provide a rolling chair frame wherein each pair of the two pair of tubular, spaced-apart, and downwardly-outwardly-slanting upper leg portions of the one-piece tubular frame are substantially coplanar with a track of the pair of tubular, parallel, spaced-apart, and substantially U-shaped concave-shaped tracks of the one-piece tubular frame from which they extend.

YET STILL ANOTHER OBJECT of the present invention is to provide a rolling chair frame wherein the two pair of tubular, spaced-apart, and downwardly-outwardly-slanting upper leg portions of the one-piece tubular frame slant outwardly to a distance in substantial vertical alignment with the pair of tubular parallel and spaced-apart transverse members of the one-piece tubular frame, so that the load applied to the one-piece tubular frame by the chair and a user bearing thereon is better distributed.

STILL YET ANOTHER OBJECT of the present invention is to provide a rolling chair frame wherein the one-piece tubular frame further has two pair of tubular, spaced-apart, parallel and vertical lower leg portions.

YET STILL ANOTHER OBJECT of the present invention is to provide a rolling chair frame wherein each portion of the two pair of tubular, spaced-apart, and vertical lower leg portions of the one-piece tubular frame extends vertically downwardly from a lower end of a respective portion of the two pair of tubular, spaced-apart, and downwardly-outwardly-slanting upper leg portions of the one-piece tubular frame.

STILL YET ANOTHER OBJECT of the present invention is to provide a rolling chair frame wherein the one-piece tubular frame further has a pair of tubular, spaced-apart, parallel, and horizontal leg cross braces.

YET STILL ANOTHER OBJECT of the present invention is to provide a rolling chair frame wherein each cross brace of the pair of tubular, spaced-apart, parallel, and horizontal leg cross braces of the one-piece tubular frame is disposed below, and substantially co-planar with, a respective track of the pair of tubular, parallel, spaced-apart, and substantially U-shaped concave-shaped tracks of the one-piece tubular frame.

STILL YET ANOTHER OBJECT of the present invention is to provide a rolling chair frame wherein each cross brace of the pair of tubular, spaced-apart, parallel, and horizontal leg lower cross braces of the one-piece tubular frame extends horizontally from, and connects lower ends of, a respective pair of the two pair of tubular, spaced-apart, and vertical lower leg portions of the one-piece tubular frame.

YET STILL ANOTHER OBJECT of the present invention is to provide a rolling chair frame wherein the one-piece tubular frame further has two pair of frame mounting straps that replaceably attach the rolling chair frame to the object.

STILL YET ANOTHER OBJECT of the present invention is to provide a rolling chair frame wherein each pair of the two pair of frame mounting straps rotatively engage a respective cross brace of the pair of tubular, spaced-apart, parallel, and horizontal leg cross braces of the one-piece tubular frame, so that the rolling chair frame can be replaceably attached to the object of any configuration in an easy manner, by merely rotating the two pair of frame mounting straps about the pair of tubular, spaced-apart, parallel, and horizontal leg cross braces of the one-piece tubular frame, until a compatible orientation is achieved, and then by passing a frame mounting screw through a throughbore in each strap of the mounting frame mounting straps, and into the object.

YET STILL ANOTHER OBJECT of the present invention is to provide a rolling chair frame wherein the one-piece tubular frame further has four base units.

STILL YET ANOTHER OBJECT of the present invention is to provide a rolling chair frame wherein each base unit of the four base units of the one-piece tubular frame has a hollow and cylindrically-shaped collar that replaceably receives a lower end of a respective portion of the two pair of tubular, spaced-apart, and vertical lower leg portions.

YET STILL ANOTHER OBJECT of the present invention is to provide a rolling chair frame wherein the lower end of the respective portion of the two pair of tubular, spaced-apart, and vertical lower leg portions of the one-piece tubular frame is replaceably maintained in the respective base unit of the four base units of the one-piece tubular frame, by a replaceable pin that extends laterally through a lateral throughbore in the hollow and cylindrically-shaped collar of the respective base unit of the four base units of the one-piece tubular frame, and through a corresponding lateral throughbore in the lower end of the respective portion of the frame track two pair of tubular, spaced-apart, and vertical lower leg portions, so that the rolling chair frame can be removed from the object by merely removing the replaceable pin of each base unit of the four base units of the one-piece tubular frame.

STILL YET ANOTHER OBJECT of the present invention is to provide a rolling chair frame wherein each base unit of the four base units of the one-piece tubular frame further includes a mounting disk that extends perpendicularly and radially outwardly from a lower end of each hollow and cylindrically-shaped collar of each base unit of the four base units of the one-piece tubular frame, and which is attachable to the object by mounting screws that pass through throughbores therein and into the object, so that the rolling chair frame can be removed from the object by merely removing the replaceable pin of each the base unit of the four base units of the one-piece tubular frame and lifting the rolling chair frame out of the hollow and cylindrically-shaped collar of each the base unit of the four base units of the one-piece tubular frame.

YET STILL ANOTHER OBJECT of the present invention is to provide a rolling chair frame wherein the platform has a rectangular-shaped base with a pair of tubular, parallel, and spaced-apart sides with ends and midpoints, and a pair of tubular, parallel, and spaced-apart transverse sides whose ends are connected perpendicularly to the ends of the pair of tubular, parallel, and spaced-apart sides of the rectangular-shaped base of the platform, and which are disposed between, and substantially parallel to, the pair of tubular parallel and spaced-apart transverse members of the one-piece tubular frame.

STILL YET ANOTHER OBJECT of the present invention is to provide a rolling chair frame wherein each side of the pair of tubular, parallel, and spaced-apart sides of the rectangular-shaped base of the platform further has a pair of parallel, downwardly-extending, spaced-apart, inverted substantially U-shaped, and short end guide housings that extend perpendicularly downwardly therefrom, at the ends thereof, to slightly past the convex-shaped lower surface of a respective track of the pair of tubular, parallel, spaced-apart, and substantially U-shaped concavo-convex tracks of the one-piece tubular frame.

YET STILL ANOTHER OBJECT of the present invention is to provide a rolling chair frame wherein each side of the pair of tubular, parallel, and spaced-apart sides of the rectangular-shaped base of the platform further has a downwardly-extending, inverted substantially U-shaped, and long midpoint guide housing that extends perpendicularly downwardly therefrom, at the midpoint thereof, past the convex-shaped lower surface of the respective track of the pair of tubular, parallel, spaced-apart, and substantially U-shaped tracks of the one-piece tubular frame, and which is longer than the pair of parallel, downwardly-extending, spaced-apart, inverted substantially U-shaped, and short end guide housings of each side of the pair of tubular, parallel, and spaced-apart sides of the rectangular-shaped base of the platform.

STILL YET ANOTHER OBJECT of the present invention is to provide a rolling chair frame wherein the movable mounting apparatus includes four end roller wheel assemblies.

YET STILL ANOTHER OBJECT of the present invention is to provide a rolling chair frame wherein each assembly of the four end roller wheel assemblies of the movable mounting apparatus is rotatively mounted in a respective end guide housing of the pair of parallel, downwardly-extending, spaced-apart, inverted substantially U-shaped, and short end guide housings of each side of the pair of tubular, parallel, and spaced-apart sides of the rectangular-shaped base of the platform, and which is in rolling contact with the concave-shaped upper surface of the respective track of the pair of tubular, parallel, spaced-apart, and substantially U-shaped tracks of the one-piece tubular frame.

STILL YET ANOTHER OBJECT of the present invention is to provide a rolling chair frame wherein the preventing apparatus includes a pair of midpoint roller wheel assemblies.

YET STILL ANOTHER OBJECT of the present invention is to provide a rolling chair frame wherein each assembly of the pair of midpoint roller wheel assemblies of the preventing apparatus is rotatively mounted in a respective downwardly-extending, inverted substantially U-shaped, and long midpoint guide housing of each side of the pair of tubular, parallel, and spaced-apart sides of the rectangular-shaped base of the platform, and is in rolling contact with the lower surface of the respective track of the pair of tubular, parallel, spaced-apart, and substantially U-shaped tracks of the one-piece tubular frame, so that the rolling contact of the four end roller wheel assemblies of the movable mounting apparatus with the concave-shaped upper surface of the pair of tubular, parallel, spaced-apart, and substantially U-shaped tracks of the one-piece tubular frame, and the rolling contact of the midpoint roller wheel assembly of the preventing apparatus with the convex-shaped lower surface of the pair of tubular, parallel, spaced-apart, and substantially U-shaped tracks of the one-piece tubular frame, rollably engage the pair of tubular, parallel, spaced-apart, and substantially U-shaped tracks of the one-piece tubular frame therebetween, with the pair of tubular, parallel, and spaced-apart sides of the rectangular-shaped base of the platform moving substantially parallel to the pair of tubular, parallel, spaced-apart, and substantially U-shaped shaped tracks of the one-piece tubular frame, so that the platform can be rotatively attached and maintained to the one-piece tubular frame without the need for any additional attachment structure so as to add to the lightweight of the rolling chair frame.

STILL YET ANOTHER OBJECT of the present invention is to provide a rolling chair frame wherein the platform is prevented from rolling off the ends of the pair of tubular, parallel, spaced-apart, and substantially U-shaped concavo-convex tracks of the one-piece tubular frame, by the midpoint roller wheel assembly of the preventing apparatus contacting, and thereby being blocked by, the two pair of tubular, spaced-apart, and downwardly-outwardly-slanting upper leg portions of the one-piece tubular frame.

YET STILL ANOTHER OBJECT of the present invention is to provide a rolling chair frame wherein each end roller wheel assembly of the four end roller wheel assemblies of the movable mounting apparatus has a centrally-disposed and laterally-oriented throughbore that extends centrally and laterally therethrough, and whose ends thereof expand into a pair of bearing recesses, in which bearings sit.

STILL YET ANOTHER OBJECT of the present invention is to provide a rolling chair frame wherein each end roller wheel assembly of the four end roller wheel assemblies of the movable mounting apparatus is rotatively mounted in a respective end guide housing of the pair of parallel, downwardly-extending, spaced-apart, inverted substantially U-shaped, and short end guide housings of each side of the pair of tubular, parallel, and spaced-apart sides of the rectangular-shaped base of the platform, by a pin that extends through a laterally-oriented throughbore in the respective end guide housing of the pair of parallel, downwardly-extending, spaced-apart, inverted substantially U-shaped, and short end guide housings of each side of the pair of tubular, parallel, and spaced-apart sides of the platform rectangular-shaped base of the platform, and through the centrally-disposed and laterally-oriented throughbore in the respective end roller wheel assembly of the four end roller wheel assemblies of the movable mounting apparatus.

YET STILL ANOTHER OBJECT of the present invention is to provide a rolling chair frame wherein each assembly of the pair of midpoint roller wheel assemblies of the preventing apparatus has a centrally-disposed and laterally-oriented throughbore that extends centrally and laterally therethrough and whose ends expand into bearing recesses, in which bearings sit.

STILL YET ANOTHER OBJECT of the present invention is to provide a rolling chair frame wherein the midpoint roller wheel assembly of the preventing apparatus is rotatively mounted in the respective downwardly-extending, inverted substantially U-shaped, and long midpoint guide housing of the pair of tubular, parallel, and spaced-apart sides of the rectangular-shaped base of the platform, by a replaceable pin that extends laterally and replaceably through a laterally-oriented throughbore in the respective downwardly-extending, inverted substantially U-shaped, and long midpoint guide housing of the pair of tubular, parallel, and spaced-apart sides of the rectangular-shaped base of the platform, and through the centrally-disposed and laterally-oriented throughbore in the midpoint roller wheel assembly of the preventing apparatus.

YET STILL ANOTHER OBJECT of the present invention is to provide a rolling chair frame wherein the preventing apparatus further includes a dampening assembly that accomplishes at least one of adjustably dampening the speed of motion of the platform on the one-piece tubular frame and locking the platform to the one-piece tubular frame so as to immobilize the platform in a specific position thereon.

STILL YET ANOTHER OBJECT of the present invention is to provide a rolling chair frame wherein the dampening assembly of the preventing apparatus includes a stationary brake shoe that is fixedly attached to an inner surface of a innermost leg of each the downwardly-extending, inverted substantially U-shaped, and long midpoint guide housing of the pair of tubular, parallel, and spaced-apart sides of the rectangular-shaped base of the platform, and which are frictionally engagable with an inner side of a respective track of the pair of tubular, parallel, spaced-apart, and substantially U-shaped tracks of the one-piece tubular frame.

YET STILL ANOTHER OBJECT of the present invention is to provide a rolling chair frame wherein the dampening assembly of the preventing apparatus further includes a movable brake shoe that is movably attached to an inner surface of an outermost leg of each the downwardly-extending, inverted substantially U-shaped, and long midpoint guide housing of the pair of tubular, parallel, and spaced-apart sides of the rectangular-shaped base of the platform, in opposing alignment to the stationary brake shoe of the dampening assembly of the preventing apparatus, and which are frictionally engagable with an outer side of the respective track of the pair of tubular, parallel, spaced-apart, and substantially U-shaped tracks of the one-piece tubular frame.

STILL YET ANOTHER OBJECT of the present invention is to provide a rolling chair frame wherein the movable brake shoe of the dampening assembly of the preventing apparatus is fixedly attached to an end of a screw that extends laterally through, and threadably engages, a laterally-oriented throughbore in the outermost leg of each midpoint guide housing of the pair of parallel, downwardly-extending, spaced-apart, inverted substantially U-shaped, and long midpoint guide housings of the pair of tubular, parallel, and spaced-apart sides of the rectangular-shaped base of the platform.

FINALLY, YET STILL ANOTHER OBJECT of the present invention is to provide a rolling chair frame wherein the dampening assembly of the preventing apparatus further includes a knob that is fixedly attached to a protruding end of the screw of the dampening assembly of the preventing apparatus, so that by turning the knob of the dampening assembly of the preventing apparatus, the movable brake shoe of the dampening assembly of the preventing apparatus contacts a respective track of the pair of tubular, parallel, spaced-apart, and substantially U-shaped concave-shaped tracks of the one-piece tubular frame and which is thereby forced against the stationary brake shoe of the dampening assembly of the preventing apparatus until the desired amount of dampening is achieved.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Preferred Embodiment

Figure 1:
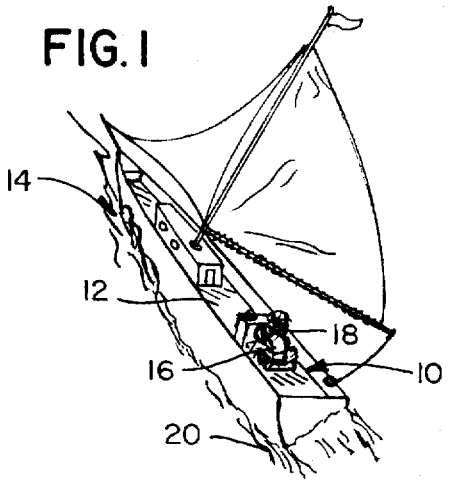
FIG. 1 is a diagrammatic perspective view illustrating the present invention being utilized on a sailboat.

10 rolling chair frame of the present invention
12 sailboat deck
14 sailboat
16 chair
18 user
22 one-piece tubular frame
24 platform
26 frame pair of tubular, parallel, spaced-apart, and substantially U-shaped concavo-convex tracks
28 frame pair of tubular, parallel, and spaced-apart transverse members
30 frame track concave-shaped upper surface
32 frame track convex-shaped lower surface
34 frame two pair of tubular, spaced-apart, and downwardly-outwardly-slanting upper leg portions
36 frame track two pair of tubular, spaced-apart, parallel and vertical lower leg portions
38 frame track pair of tubular, spaced-apart, parallel, and horizontal leg cross braces
39 pair of frame mounting straps
40 platform rectangular-shaped base
41 frame mounting screw
43 frame mounting strap throughbore
42 platform base pair of tubular, parallel, and spaced-apart sides
44 platform base pair of tubular, parallel, and spaced-apart transverse sides
46 platform base corners
48 platform base side midpoint
50 platform base side pair of parallel, downwardly-extending, spaced-apart, inverted substantially U-shaped, and short end guide housings
52 platform base downwardly-extending, inverted substantially U-shaped, and long midpoint guide housing
54 platform base side end roller wheel assembly
56 platform base side midpoint roller wheel assembly
58 platform base side end roller wheel assembly centrally-disposed and laterally-oriented throughbore
60 platform base side end roller wheel assembly pair of bearing recesses
62 platform base side end roller wheel assembly bearings
64 platform base side end roller wheel assembly pin
66 platform base side end guide housing laterally-oriented throughbore
67 platform base side midpoint roller wheel assembly centrally-disposed and laterally-oriented throughbore
68 platform base side midpoint roller wheel assembly pair of bearing recesses
70 platform base side midpoint roller wheel bearings
72 platform base side midpoint roller wheel assembly replaceable pin
74 platform base side midpoint guide housing laterally-oriented throughbore
76 dampening assembly
78 dampening assembly stationary brake shoe
80 dampening assembly movable brake shoe
82 dampening assembly screw
84 platform base side midpoint guide housing laterally-oriented throughbore
86 dampening assembly knob

Alternate Embodiment

110 rolling chair frame of the present invention
112 one-piece tubular frame
138 frame four base units
140 frame base unit hollow and cylindrically-shaped collar
142 frame base unit replaceable pin
144 frame base unit lateral throughbore
146 frame base unit mounting disk
148 frame base unit mounting screws

DETAILED DESCRIPTION OF THE PREFERRED EMBODIMENT

Referring now to the figures in which like numerals indicate like parts, and particularly to FIG. 1, which is a diagrammatic perspective view of a preferred embodiment of the present invention, a preferred embodiment of the rolling chair frame of the present invention is shown generally at 10 that is replaceably mounted to a sailboat deck 12 of a sailboat 14, and which has a chair 16 replaceably mounted thereon upon which a user 18 is comfortably sitting, at a substantially level orientation, as the sailboat 14 heels under the rolling action of water 20.

It is to be understood that the components of the rolling chair frame 10 can be connected to each other by any known means comprising welding, brackets, braces, nuts, bolts, pins, rivets or any other means available for attaching and connecting objects, in addition to being used to connect the chair 16 to the rolling chair frame 10, without departing in any way from the spirit of the present invention.

The general configuration of the preferred embodiment of the rolling chair frame 10 can best be seen in FIG. 2, which is a diagrammatic perspective view of the present invention, and as such will be discussed with reference thereto.

The rolling chair frame 10 includes a one-piece tubular frame 22 and a platform 24 that is movably mounted to the one-piece tubular frame 22.

Figure 4:
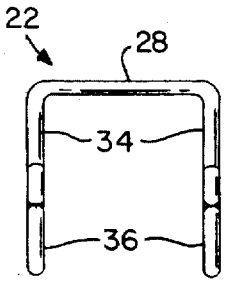
FIG. 4 is an enlarged diagrammatic end elevational view taken generally in the direction of arrow 4 in FIG. 3.
Figure 3:
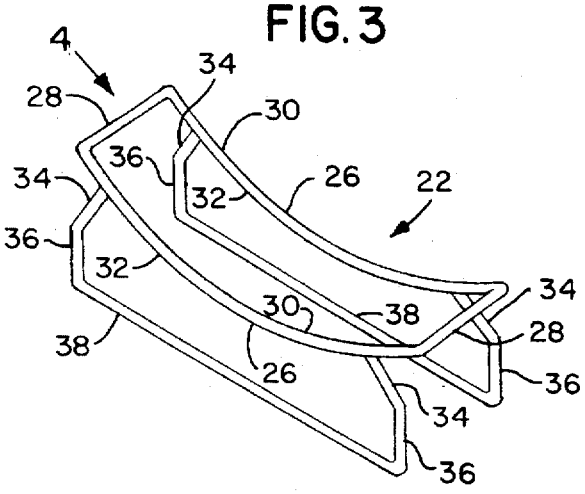
FIG. 3 is a diagrammatic perspective view of the one-piece tubular frame of the preferred embodiment of the present invention.

The specific configuration of a preferred embodiment of the one-piece tubular frame 22 can best be seen in FIGS. 2–4, which are a diagrammatic perspective view of the preferred embodiment of the present invention, a diagrammatic perspective view of the one-piece frame of the preferred embodiment of the present invention, and an enlarged diagrammatic end elevational view taken generally in the direction of arrow 4 in FIG. 3, respectively, and as such will be discussed with reference thereto.

The one-piece tubular frame 22 includes a frame pair of tubular, parallel, spaced-apart, and substantially U-shaped concavo-convex tracks 26 that are connected to each other, at their ends, by a frame pair of tubular, parallel, and spaced-apart transverse members 28.

Each track of the frame pair of tubular, parallel, spaced-apart, and substantially U-shaped concavo-convex tracks 26 of the one-piece tubular frame 22 has a frame track concave-shaped upper surface 30, and a frame track convex-shaped lower surface 32 that is parallel to, and disposed below, the frame track concave-shaped upper surface 30 of the frame pair of tubular, parallel, spaced-apart, and substantially U-shaped concave-shaped tracks 26 of the one-piece tubular frame 22.

The one-piece tubular frame 22 further has a frame two pair of tubular, spaced-apart, and downwardly-outwardly-slanting upper leg portions 34.

Each pair of the frame two pair of tubular, spaced-apart, and downwardly-outwardly-slanting upper leg portions 34 of the one-piece tubular frame 22 slant downwardly and outwardly, in a straight line, from the frame track convex-shaped lower surface 32 of each track of the frame pair of tubular, parallel, spaced-apart, and substantially U-shaped concave-shaped tracks 26 of the one-piece tubular frame 22, inboard of the ends thereof, and preferably to a distance in substantial vertical alignment with the frame pair of tubular parallel and spaced-apart transverse members 28 of the one-piece tubular frame 22, so that the load applied to the one-piece tubular frame 22 by the chair 16 and the user 18 is better distributed.

Each pair of the frame two pair of tubular, spaced-apart, and downwardly-outwardly-slanting upper leg portions 34 of the one-piece tubular frame 22 are substantially co-planar with the track of the frame pair of tubular, parallel, spaced-apart, and substantially U-shaped concave-shaped tracks 26 of the one-piece tubular frame 22 from which they extend.

It is to be understood, however, that the frame two pair of tubular, spaced-apart, and downwardly-outwardly-slanting upper leg portions 34 of the one-piece tubular frame 22 can slant downwardly and outwardly, in a straight line, from the frame track convex-shaped lower surface 32 of the frame pair of tubular, parallel, spaced-apart, and substantially U-shaped concave-shaped tracks 26 of the one-piece tubular frame 22 to any distance so as to afford particular installations that will accommodate for shape and design of the particular sailboat without departing in any way from the spirit of the present invention.

It is to be further understood that the position of the frame two pair of tubular, spaced-apart, and downwardly-outwardly-slanting upper leg portions 34 of the one-piece tubular frame 22 will in fact affect the degree of rotation that the rolling chair frame 10 can achieve, and it is therefore intended that this angle be variable without departing in any way from the spirit of the present invention.

The one-piece tubular frame 22 further has a frame track two pair of tubular, spaced-apart, parallel and vertical lower leg portions 36.

Each portion of the frame track two pair of tubular, spaced-apart, and vertical lower leg portions 36 of the one-piece tubular frame 22 extends vertically downwardly from a lower end of a respective portion of the frame track two pair of tubular, spaced-apart, and downwardly-outwardly-slanting upper leg portions 34 of the one-piece tubular frame 22.

The one-piece tubular frame 22 further has a frame track pair of tubular, spaced-apart, parallel, and horizontal leg cross braces 38.

Each cross brace of the frame track pair of tubular, spaced-apart, parallel, and horizontal leg cross braces 38 of the one-piece tubular frame 22 is disposed below, and substantially coplanar with, a respective track of the frame pair of tubular, parallel, spaced-apart, and substantially U-shaped concave-shaped tracks 26 of the one-piece tubular frame 22.

Each cross brace of the frame track pair of tubular, spaced-apart, parallel, and horizontal leg lower cross braces 38 of the one-piece tubular frame 22 extends horizontally from, and connects the lower ends of, a respective pair of the frame track two pair of tubular, spaced-apart, and vertical lower leg portions 36 of the one-piece tubular frame 22.

The rolling chair frame 10 is replaceably attached to the sailboat deck 12 of the sailboat 14, preferably by a pair of frame mounting straps 39 that rotatively engage a respective cross brace of the frame track pair of tubular, spaced-apart, parallel, and horizontal leg cross braces 38 of the one-piece tubular frame 22, so that the rolling chair frame 10 can be replaceably attached to the sailboat deck 12 of the sailboat 14 of any configuration in an easy manner, by merely rotating the pair of frame mounting straps 39 about the respective cross brace of the frame track pair of tubular, spaced-apart, parallel, and horizontal leg cross braces 38 of the one-piece tubular frame 22, until a compatible orientation is achieved, and then by passing a frame mounting screw 41 through a frame mounting strap throughbore 43 in each strap of the mounting frame mounting straps 39, and into the sailboat deck 12 of the sailboat 14.

To remove the rolling chair frame 10 from the sailboat deck 12 of the sailboat 14, one merely removes the frame mounting screw 41 from the frame mounting strap throughbore 43 in each strap of the mounting frame mounting straps 39.

Figure 2:
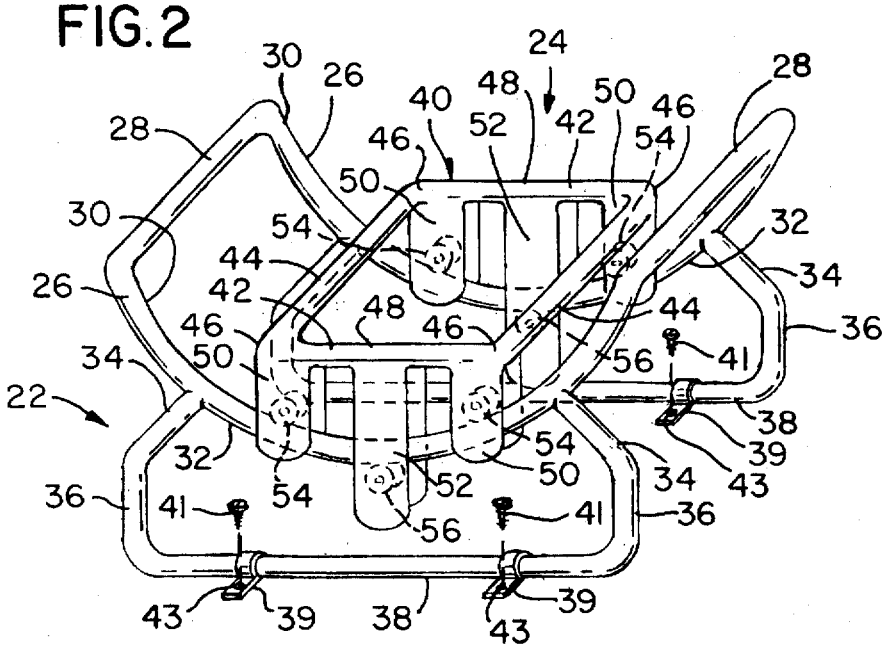
FIG. 2 is a diagrammatic perspective view of a preferred embodiment of the present invention.

As shown in FIG. 2, which is a diagrammatic perspective view of a preferred embodiment of the present invention, the platform 24 has a platform rectangular-shaped base 40 with a platform base pair of tubular, parallel, and spaced-apart sides 42, and a platform base pair of tubular, parallel, and spaced-apart transverse sides 44, whose ends are connected perpendicularly to the ends of the platform base pair of tubular, parallel, and spaced-apart sides 42 of the platform rectangular-shaped base 40 of the platform 24 at platform base corners 46, and which are disposed, between and substantially parallel to, the frame pair of tubular parallel and spaced-apart transverse members 28 of the one-piece tubular frame 22.

Each side of the platform base pair of tubular, parallel, and spaced-apart sides 42 of the platform rectangular-shaped base 40 of the platform 24 has a platform base side midpoint 48 that is substantially equidistant between the platform base corners 46 of the platform rectangular-shaped base 40 of the platform 24.

Each side of the platform base pair of tubular, parallel, and spaced-apart sides 42 of the platform rectangular-shaped base 40 of the platform 24 further has a platform base side pair of parallel, downwardly-extending, spaced-apart, inverted substantially U-shaped, and short end guide housings 50 that extend perpendicularly downwardly therefrom, at the platform base corners 46 of the platform rectangular-shaped base 40 of the platform 24, to slightly past the frame track convex-shaped lower surface 32 of a respective track of the frame pair of tubular, parallel, spaced-apart, and substantially U-shaped concavo-convex tracks 26 of the one-piece tubular frame 22.

Each side of the platform base pair of tubular, parallel, and spaced-apart sides 42 of the platform rectangular-shaped base 40 of the platform 24 further has a platform base downwardly-extending, inverted substantially U-shaped, and long midpoint guide housing 52 that extends perpendicularly downwardly therefrom, at the platform base side midpoint 48 thereof, to a level past the frame track convex-shaped lower surface 32 of the respective track of the frame pair of tubular, parallel, spaced-apart, and substantially U-shaped tracks 26 of the one-piece tubular frame 22, and which is longer than the platform base side pair of parallel, downwardly-extending, spaced-apart, inverted substantially U-shaped, and short end guide housings 50 of the platform base pair of tubular, parallel, and spaced-apart sides 42 of the platform rectangular-shaped base 40 of the platform 24.

Each end guide housing of the platform base side pair of parallel, downwardly-extending, spaced-apart, inverted substantially U-shaped, and short end guide housings 50 of the platform base pair of tubular, parallel, and spaced-apart sides 42 of the platform rectangular-shaped base 40 of the platform 24 has a platform base side end roller wheel assembly 54 that is rotatively mounted therein, and which is in rolling contact with the frame track concave-shaped upper surface 30 of the respective track of the frame pair of tubular, parallel, spaced-apart, and substantially U-shaped tracks 26 of the one-piece tubular frame 22.

Each platform base downwardly-extending, inverted substantially U-shaped, and long midpoint guide housing 52 of the platform base pair of tubular, parallel, and spaced-apart sides 42 of the platform rectangular-shaped base 40 of the platform 24 has a platform base side midpoint roller wheel assembly 56 that is rotatively mounted therein, and which is in rolling contact with the frame track convex-shaped lower surface 32 of a respective track of the frame pair of tubular, parallel, spaced-apart, and substantially U-shaped tracks 26 of the one-piece tubular frame 22.

Figure 5:
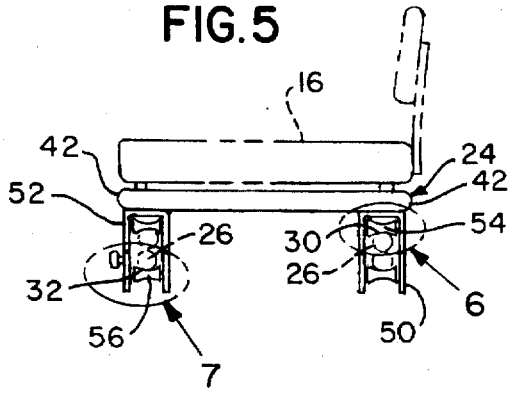
FIG. 5 is a diagrammatic side elevational view illustrating the roller wheel assemblies of the present invention.

As shown in FIG. 5, which is a diagrammatic side elevational view illustrating the roller assemblies of the present invention, it is to be understood that the rolling contact of the platform base side end roller wheel assemblies 54 of the platform base side pair of parallel, downwardly-extending, spaced-apart, inverted substantially U-shaped, and short end guide housings 50 of the platform 24 with the frame track concave-shaped upper surface 30 of the frame pair of tubular, parallel, spaced-apart, and substantially U-shaped tracks 26 of the one-piece tubular frame 22, and the rolling contact of the platform base side midpoint roller wheel assemblies 56 of the platform base downwardly-extending, inverted substantially U-shaped, and long midpoint guide housing 52 of the platform 24 with the frame track convex-shaped lower surface 32 of the frame pair of tubular, parallel, spaced-apart, and substantially U-shaped tracks 26 of the one-piece tubular frame 22, rollably engage the frame pair of tubular, parallel, spaced-apart, and substantially U-shaped tracks 26 of the one-piece tubular frame 22 therebetween, with the platform base pair of tubular, parallel, and spaced-apart sides 42 of the platform rectangular-shaped base 40 of the platform 24 moving substantially parallel to the frame pair of tubular, parallel, spaced-apart, and substantially U-shaped tracks 26 of the one-piece tubular frame 22, so that the platform 24 can be rotatively attached to the one-piece tubular frame 22 without the need for any additional attachment structure so as to add to the lightweight of the rolling chair frame 10. This configuration not only provides rotative mounting but also maintains the rotative mounting in one operation.

The platform 24 is prevented from rolling off the ends of the frame pair of tubular, parallel, spaced-apart, and substantially U-shaped concavo-convex tracks 26 of the one-piece tubular frame 22, by the platform base side midpoint roller wheel assemblies 56 of the platform base downwardly-extending, inverted substantially U-shaped, and long midpoint guide housing 52 of the platform 24 contacting, and thereby being blocked by, the frame two pair of tubular, spaced-apart, and downwardly-outwardly-slanting upper leg portions 34 of the one-piece tubular frame 22.

It is to be understood, however, that the frame two pair of tubular, spaced-apart, and downwardly-outwardly-slanting upper leg portions 34 of the one-piece tubular frame 22 must be disposed at such a position so as to prevent the platform base side end roller wheel assemblies 54 from riding over the ends of the frame pair of tubular, parallel, spaced-apart, and substantially U-shaped concavo-convex tracks 26 of the one-piece tubular frame 22.

Figure 6:
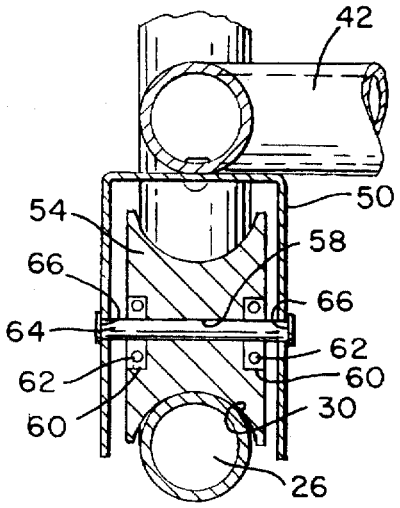
FIG. 6 is an enlarged diagrammatic elevational view, in partial section, of the area generally enclosed by the broken ellipse generally identified by arrow 6 in FIG. 5.

The specific configuration of the platform base side end roller wheel assembly 54 can best be seen in FIG. 6, which is an enlarged diagrammatic elevational view, in partial cross section, of the area generally enclosed by the broken ellipse generally identified by arrow 6 in FIG. 5, and as such will be discussed with reference thereto.

The platform base side end roller wheel assembly 54 has a platform base side end roller wheel assembly centrally-disposed and laterally-oriented throughbore 58 that extends centrally and laterally therethrough, and whose ends expand into a platform base side end roller wheel assembly pair of bearing recesses 60, in which platform base side end roller wheel assembly bearings 62 sit.

The platform base side end roller wheel assembly 54 is rotatively mounted in a respective end guide housing of the platform base side pair of parallel, downwardly-extending, spaced-apart, inverted substantially U-shaped, and short end guide housings 50 of the platform base pair of tubular, parallel, and spaced-apart sides 42 of the platform rectangular-shaped base 40 of the platform 24, by a platform base side end roller wheel assembly pin 64 that extends laterally through a platform base side end guide housing laterally-oriented throughbore 66 that extends laterally through the respective end guide housing of the platform base side pair of parallel, downwardly-extending, spaced-apart, inverted substantially U-shaped, and short end guide housings 50 of the platform base pair of tubular, parallel, and spaced-apart sides 42 of the platform rectangular-shaped base 40 of the platform 24, and through the platform base side end roller wheel assembly centrally-disposed and laterally-oriented throughbore 58 in the platform base side end roller wheel assembly 54 of the respective end guide housing of the platform base side pair of parallel, downwardly-extending, spaced-apart, inverted substantially U-shaped, and short end guide housings 50 of the platform base pair of tubular, parallel, and spaced-apart sides 42 of the platform rectangular-shaped base 40 of the platform 24.

Figure 7:
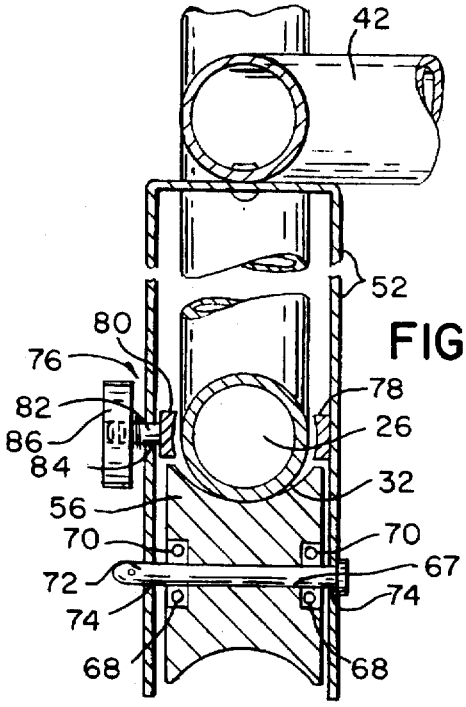
FIG. 7 is an enlarged diagrammatic elevational view, in partial section, of the area generally enclosed by the broken ellipse generally identified by arrow 7 in FIG. 5.

The specific configuration of the platform base side midpoint roller wheel assembly 56 can best be seen in FIG. 7, which is an enlarged diagrammatic elevational view, in partial cross section, of the area generally enclosed by the broken ellipse generally identified by arrow 7 in FIG. 5, and as such will be discussed with reference thereto.

The platform base side midpoint roller wheel assembly 56 has a platform base side midpoint roller wheel assembly centrally-disposed and laterally-oriented throughbore 67 that extends centrally and laterally therethrough and whose ends expand into platform base side midpoint roller wheel assembly pair of bearing recesses 68, in which platform base side midpoint roller wheel bearings 70 sit.

The platform base side midpoint roller wheel assembly 56 is rotatively mounted in the respective platform base downwardly-extending, inverted substantially U-shaped, and long midpoint guide housing 52 of the platform base pair of tubular, parallel, and spaced-apart sides 42 of the platform rectangular-shaped base 40 of the platform 24, by a platform base side midpoint roller wheel assembly replaceable pin 72 that extends laterally and replaceably through a platform base side midpoint guide housing laterally-oriented throughbore 74 that extends laterally through the respective platform base downwardly-extending, inverted substantially U-shaped, and long midpoint guide housing 52 of the platform base pair of tubular, parallel, and spaced-apart sides 42 of the platform rectangular-shaped base 40 of the platform 24, and through the platform base side midpoint roller wheel assembly centrally-disposed and laterally-oriented throughbore 74 in the platform base side midpoint roller wheel assembly 56 of the respective platform base downwardly-extending, inverted substantially U-shaped, and long midpoint guide housing 52 of the platform base pair of tubular, parallel, and spaced-apart sides 42 of the platform rectangular-shaped base 40 of the platform 24.

The platform base side midpoint roller wheel assembly 56 further includes a dampening assembly 76 that either adjustably dampens the speed of motion of the platform 24 on the one-piece tubular frame 22 or locks the platform 24 thereto so as to immobilize the platform 24 in a specific position thereon, if so desired.

The dampening assembly 76 of the platform base side midpoint roller wheel assembly 56 includes a dampening assembly stationary brake shoe 78 that is fixedly attached to an inner surface of a innermost leg of each midpoint guide housing of the platform base downwardly-extending, inverted substantially U-shaped, and long midpoint guide housing 52 of the platform base pair of tubular, parallel, and spaced-apart sides 42 of the platform rectangular-shaped base 40 of the platform 24, and which is frictionally engagable with an inner side of a respective track of the frame pair of tubular, parallel, spaced-apart, and substantially U-shaped tracks 26 of the one-piece tubular frame 22.

The dampening assembly 76 of the platform base side midpoint roller wheel assembly 56 further includes a dampening assembly movable brake shoe 80 that is movably attached to the inner surface of the outermost leg of each midpoint guide housing of the platform base downwardly-extending, inverted substantially U-shaped, and long midpoint guide housing 52 of the platform base pair of tubular, parallel, and spaced-apart sides 42 of the platform rectangular-shaped base 40 of the platform 24, in opposing alignment to the dampening assembly stationary brake shoe 78, and which is frictionally engagable with the outer side of the respective track of the frame pair of tubular, parallel, spaced-apart, and substantially U-shaped tracks 26 of the one-piece tubular frame 22.

The dampening assembly movable brake shoe 80 of the platform base side midpoint roller wheel assembly 56 of the dampening assembly 76 is fixedly attached to an end of a dampening assembly screw 82 that extends laterally through, and threadably engages, a platform base side midpoint guide housing laterally-oriented throughbore 84 in the outermost leg of the respective midpoint guide housing of the platform base side pair of parallel, downwardly-extending, spaced-apart, inverted substantially U-shaped, and long midpoint guide housings 52 of the platform base pair of tubular, parallel, and spaced-apart sides 42 of the platform rectangular-shaped base 40.

The dampening assembly 76 further includes a dampening assembly knob 86 that is fixedly attached to another end of the dampening assembly screw 82 of the dampening assembly 76, so that by turning the dampening assembly knob 86 of the dampening assembly 76, the dampening assembly movable brake shoe 80 of the dampening assembly 76 contacts the respective track of the frame pair of tubular, parallel, spaced-apart, and substantially U-shaped concave-shaped tracks 26 of the one-piece tubular frame 22 is forced against the dampening assembly stationary brake shoe 78 of the dampening assembly 76, and vise versa. Depending upon the amount of contact therebetween, the amount of dampening or the ultimate locking thereof will be determined.

It is to be understood, however, that the dampening assembly movable brake shoe 80 of the dampening assembly 76 can contact a respective track of the frame pair of tubular, parallel, spaced-apart, and substantially U-shaped concave-shaped tracks 26 of the one-piece tubular frame 22 without forcing it against the dampening assembly stationary brake shoe 78 of the dampening assembly 76 for minimal dampening thereof.

Figure 8:
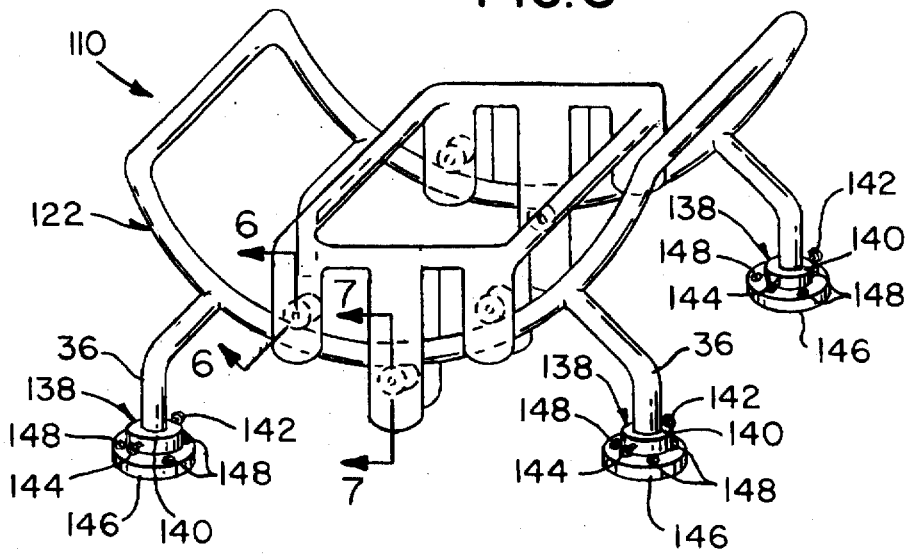
FIG. 8 is a diagrammatic perspective view of an alternate embodiment of the present invention.

The general configuration of an alternate embodiment of the rolling chair frame 110 can best be seen in FIG. 8, which is a diagrammatic perspective view of an alternate embodiment of the present invention, and as such will be discussed with reference thereto.

The rolling chair frame 110 is identical to the rolling chair frame 10, except for a one-piece tubular frame 122 which is slightly different than the one-piece tubular frame 22.

The one-piece tubular frame 122 is identical to the one-piece tubular frame 22, except that the frame track pair of tubular, spaced-apart, parallel, and horizontal leg lower cross braces 38 of the one-piece tubular frame 22 are replaced with frame four base units 138.

Each base unit of the frame four base units 138 has a frame base unit hollow and cylindrically-shaped collar 140 that replaceably receives the lower end of a respective portion of the frame track two pair of tubular, spaced-apart, and vertical lower leg portions 36.

The lower end of the respective portion of the frame track two pair of tubular, spaced-apart, and vertical lower leg portions 36 is replaceably maintained in the respective base unit of the frame four base units 138, by a frame base unit replaceable pin 142 that extends laterally through a frame base unit lateral throughbore 144 that extends laterally through the frame base unit hollow and cylindrically-shaped collar 140, and through a corresponding lateral throughbore in the lower end of the respective portion of the frame track two pair of tubular, spaced-apart, and vertical lower leg portions 36.

Each base unit of the frame four base units 138 further includes a frame base unit mounting disk 146 that extends perpendicularly and radially outwardly from the lower end of the respective frame base unit hollow and cylindrically-shaped collar 140, and which is attachable to the sailboat deck 12 of the sailboat 14, by frame base unit mounting screws 148 that pass through throughbores therein and into the sailboat deck 12 of the sailboat 14.

To remove the rolling chair frame 10 from the sailboat deck 12 of the sailboat 14, one merely removes the frame base unit replaceable pins 142 and lifts the rolling chair frame 10 out of the frame base unit hollow and cylindrically-shaped collars 140.

It is to be understood that if it is desired to also remove the platform 24 form the one-piece tubular frame 22, 122, one merely removes the platform base side midpoint roller wheel assembly replaceable pins 72 of the platform base side midpoint roller wheel assembly 56, and lift the platform 24 upwardly.

It is to be further understood, however, that many other means exist for connecting the rolling chair frame 10 to the sailboat deck 12 of the sailboat 14 at the time of the present invention, and it is thereby intended that existing technology can easily be adapted therefor without departing in any way from the spirit of the present invention.

The operation of the rolling chair frame 10, 110, can best be seen in FIGS. 9A, 9B, and 9C, and as such will be discussed with reference thereto.

Figure 9C:
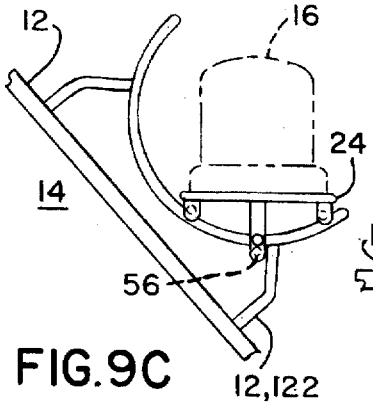
FIG. 9C is a diagrammatic front elevational view illustrating the present invention at maximum relative tilt.
Figure 9A:
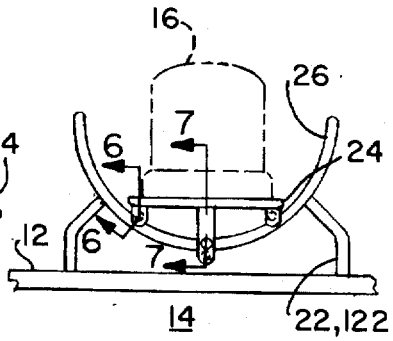
FIG. 9A is a diagrammatic front elevational view illustrating the present invention at zero relative tilt.

As shown in FIG. 9A, which is a diagrammatic front elevational view illustrating the present invention at zero relative tilt, the platform 24 is disposed in the lowermost point in the frame pair of tubular, parallel, spaced-apart, and substantially U-shaped concavo-convex tracks 26 of the one-piece tubular frame 22, 122, so that the chair 16 is parallel to the sailboat deck 12 of the sailboat 14, indicating quite sea.

Figure 9B:
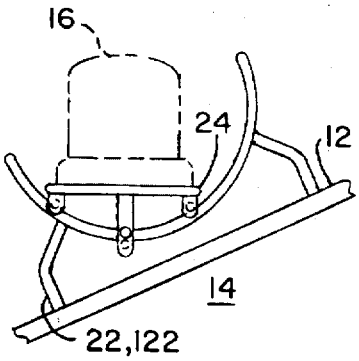
FIG. 9B is a diagrammatic front elevational view illustrating the present invention at an intermediate relative tilt.

As shown in FIG. 9B, which is a diagrammatic front elevational view illustrating the present invention at an intermediate relative tilt, the sailboat 14 has experienced some degree of heel which causes the platform 24 to freely slidably oscillate sideways along the one-piece tubular frame 22, 122, and level itself by the mere act of gravity, so that the chair 16 mounted thereon remains level.

As shown in FIG. 9C, which is a diagrammatic front elevational view illustrating the present invention at maximum relative tilt, the sailboat 14 has experienced a greater degree of heel which causes the platform 24 to freely slidably oscillate sideways along the one-piece tubular frame 22, 122, however, only until the platform base side midpoint roller wheel assemblies 56 contact the frame two pair of tubular, spaced-apart, and downwardly-outwardly-slanting upper leg portions 34 of the one-piece tubular frame 22, as discussed, supra, so that the leveling of the chair 16 mounted thereon is in fact limited by this factor.

It has been shown that the chair 16 that is replaceably mounted to the rolling chair frame 10, 110 always remains essentially level to the water 20 as the sailboat 14 heels.

It is to be understood that the configurations of the various components of the present invention are not merely a matter of design choice but are of significant and of critical importance for, inter alia, the functions that they accomplish as discussed, supra, and any not explicitly expressed but inherent thereto. They therefore must be considered in determining patentability. Support for this assertion can be found in In re Dailey et al., 149 U.S.P.Q. 47 (CCPA 1976), where the Court held that the shape of a device must be considered in determining patentability, if the shape is significant:

> ". . . the configuration of the container is a 'mere matter of choice' not significantly novel . . . , [since] . . . Appellants have provided no argument which convinces us that the particular configuration of their container is significant . . . " [Emphasis added]

It will be understood that each of the elements described above, or two or more together, may also find a useful application in other types of constructions differing from the types described above.

While the invention has been illustrated and described as embodied in a rolling chair frame, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A rolling chair frame, comprising:

a) a one-piece tubular frame being attachable to a movable object;

b) a platform being sidewardly movably mounted to said one-piece tubular frame and being adapted to replaceably receive a chair;

c) preventing means for preventing removal of said platform from said one-piece tubular frame, so that said platform cannot be unintentionally removed from said one-piece tubular frame; and d) movable mounting means for sidewardly movably mounting said platform to said one-piece tubular frame and maintaining said platform level as the movable object moves.

2. The frame as defined in claim 1, wherein said one-piece tubular frame has a pair of tubular, parallel, spaced-apart, and substantially U-shaped concavo-convex tracks that are connected to each other, at ends thereof, by a pair of tubular, parallel, and spaced-apart transverse members.

3. The frame as defined in claim 2, wherein each track of said pair of tubular, parallel, spaced-apart, and substantially U-shaped concavo-convex tracks of said one-piece tubular frame has a concave-shaped upper surface, and a convex-shaped lower surface that is parallel to, and disposed below, said concave-shaped upper surface of said pair of tubular, parallel, spaced-apart, and substantially U-shaped concave-shaped tracks of said one-piece tubular frame.

4. The frame as defined in claim 3, wherein said one-piece tubular frame further has two pair of tubular, spaced-apart, and downwardly-outwardly-slanting upper leg portions; each pair of said two pair of tubular, spaced-apart, and downwardly-outwardly-slanting upper leg portions of said one-piece tubular frame slant downwardly and outwardly, in a straight line, from said lower surface of each track of said pair of tubular, parallel, spaced-apart, and substantially U-shaped concave-shaped tracks of said one-piece tubular frame, inboard of said ends thereof so as to accommodate for different shapes and designs of the object; each pair of said two pair of tubular, spaced-apart, and downwardly-outwardly-slanting upper leg portions of said one-piece tubular frame are substantially co-planar with a track of said pair of tubular, parallel, spaced-apart, and substantially U-shaped concave-shaped tracks of said one-piece tubular frame from which they extend.

5. The frame as defined in claim 4, wherein said two pair of tubular, spaced-apart, and downwardly-outwardly-slanting upper leg portions of said one-piece tubular frame slant outwardly to a distance in substantial vertical alignment with said pair of tubular parallel and spaced-apart transverse members of said one-piece tubular frame, so that the load applied to said one-piece tubular frame by the chair and a user bearing thereon is better distributed.

6. The frame as defined in claim 4, wherein said one-piece tubular frame further has two pair of tubular, spaced-apart, parallel and vertical lower leg portions; each portion of said two pair of tubular, spaced-apart, and vertical lower leg portions of said one-piece tubular frame extends vertically downwardly from a lower end of a respective portion of said two pair of tubular, spaced-apart, and downwardly-outwardly-slanting upper leg portions of said one-piece tubular frame.

7. The frame as defined in claim 6, wherein said one-piece tubular frame further has a pair of tubular, spaced-apart, parallel, and horizontal leg cross braces; each cross brace of said pair of tubular, spaced-apart, parallel, and horizontal leg cross braces of said one-piece tubular frame is disposed below, and substantially co-planar with, a respective track of said pair of tubular, parallel, spaced-apart, and substantially U-shaped concave-shaped tracks of said one-piece tubular frame; each cross brace of said pair of tubular, spaced-apart, parallel, and horizontal leg lower cross braces of said one-piece tubular frame extends horizontally from, and connects lower ends of, a respective pair of said two pair of tubular, spaced-apart, and vertical lower leg portions of said one-piece tubular frame.

8. The frame as defined in claim 7, wherein said one-piece tubular frame further has two pair of frame mounting straps that replaceably attach said rolling chair frame to the object; each pair of said two pair of frame mounting straps rotatively engage a respective cross brace of said pair of tubular, spaced-apart, parallel, and horizontal leg cross braces of said one-piece tubular frame, so that said rolling chair frame can be replaceably attached to the object of any configuration in an easy manner, by merely rotating said two pair of frame mounting straps about said pair of tubular, spaced-apart, parallel, and horizontal leg cross braces of said one-piece tubular frame, until a compatible orientation is achieved, and then by passing a frame mounting screw through a throughbore in each strap of said mounting frame mounting straps, and into the object.

9. The frame as defined in claim 6, wherein said one-piece tubular frame further has four base units; each base unit of said four base units of said one-piece tubular frame has a hollow and cylindrically-shaped collar that replaceably receives a lower end of a respective portion of said two pair of tubular, spaced-apart, and vertical lower leg portions.

10. The frame as defined in claim 9, wherein said lower end of said respective portion of said two pair of tubular, spaced-apart, and vertical lower leg portions of said one-piece tubular frame is replaceably maintained in said respective base unit of said four base units of said one-piece tubular frame, by a replaceable pin that extends laterally through a lateral throughbore in said hollow and cylindrically-shaped collar of said respective base unit of said four base units of said one-piece tubular frame, and through a corresponding lateral throughbore in said lower end of said respective portion of said frame track two pair of tubular, spaced-apart, and vertical lower leg portions; each base unit of said four base units of said one-piece tubular frame further includes a mounting disk that extends perpendicularly and radially outwardly from a lower end of said hollow and cylindrically-shaped collar of each base unit of said four base units of said one-piece tubular frame, and which is attachable to the object by mounting screws that pass through throughbores therein and into the object, so that said rolling chair frame can be removed from the object by merely removing said replaceable pin from each said base unit of said four base units of said one-piece tubular frame and lifting said rolling chair frame out of said hollow and cylindrically-shaped collar of each said base unit of said four base units of said one-piece tubular frame.

11. The frame as defined in claim 3, wherein said platform has a rectangular-shaped base with a pair of tubular, parallel, and spaced-apart sides with ends and midpoints, and a pair of tubular, parallel, and spaced-apart transverse sides whose ends are connected perpendicularly to said ends of said pair of tubular, parallel, and spaced-apart sides of said rectangular-shaped base of said platform, and which are disposed between, and substantially parallel to, said pair of tubular parallel and spaced-apart transverse members of said one-piece tubular frame.

12. The frame as defined in claim 11, wherein each side of said pair of tubular, parallel, and spaced-apart sides of said rectangular-shaped base of said platform further has a pair of parallel, downwardly-extending, spaced-apart, inverted substantially U-shaped, and short end guide housings that extend perpendicularly downwardly therefrom, at said ends thereof, to slightly past said convex-shaped lower surface of a respective track of said pair of tubular, parallel, spaced-apart, and substantially U-shaped concavo-convex tracks of said one-piece tubular frame.

13. The frame as defined in claim 12, wherein each side of said pair of tubular, parallel, and spaced-apart sides of said rectangular-shaped base of said platform further has a downwardly-extending, inverted substantially U-shaped, and long midpoint guide housing that extends perpendicularly downwardly therefrom, at said midpoint thereof, past said convex-shaped lower surface of said respective track of said pair of tubular, parallel, spaced-apart, and substantially U-shaped tracks of said one-piece tubular frame, and which is longer than said pair of parallel, downwardly-extending, spaced-apart, inverted substantially U-shaped, and short end guide housings of each side of said pair of tubular, parallel, and spaced-apart sides of said rectangular-shaped base of said platform.

14. The frame as defined in claim 12, wherein said movable mounting means includes four end roller wheel assemblies; each assembly of said four end roller wheel assemblies of said movable mounting means is rotatively mounted in a respective end guide housing of said pair of parallel, downwardly-extending, spaced-apart, inverted substantially U-shaped, and short end guide housings of each side of said pair of tubular, parallel, and spaced-apart sides of said rectangular-shaped base of said platform, and which is in rolling contact with said concave-shaped upper surface of said respective track of said pair of tubular, parallel, spaced-apart, and substantially U-shaped tracks of said one-piece tubular frame.

15. The frame as defined in claim 13, wherein said preventing means includes a pair of midpoint roller wheel assemblies; each assembly of said pair of midpoint roller wheel assemblies of said preventing means is rotatively mounted in a respective downwardly-extending, inverted substantially U-shaped, and long midpoint guide housing of each side of said pair of tubular, parallel, and spaced-apart sides of said rectangular-shaped base of said platform, and is in rolling contact with said lower surface of said respective track of said pair of tubular, parallel, spaced-apart, and substantially U-shaped tracks of said one-piece tubular frame, so that the rolling contact of said four end roller wheel assemblies of said movable mounting means with said concave-shaped upper surface of said pair of tubular, parallel, spaced-apart, and substantially U-shaped tracks of said one-piece tubular frame, and the rolling contact of said midpoint roller wheel assembly of said preventing means with said convex-shaped lower surface of said pair of tubular, parallel, spaced-apart, and substantially U-shaped tracks of said one-piece tubular frame, rollably engage said pair of tubular, parallel, spaced-apart, and substantially U-shaped tracks of said one-piece tubular frame therebetween, with said pair of tubular, parallel, and spaced-apart sides of said rectangular-shaped base of said platform moving substantially parallel to said pair of tubular, parallel, spaced-apart, and substantially U-shaped tracks of said one-piece tubular frame, so that said platform can be rotatively attached and maintained to said one-piece tubular frame without the need for any additional attachment structure so as to add to the lightweight of said rolling chair frame; said platform is prevented from rolling off said ends of said pair of tubular, parallel, spaced-apart, and substantially U-shaped concavo-convex tracks of said one-piece tubular frame, by said midpoint roller wheel assembly of said preventing means contacting, and thereby being blocked by, said two pair of tubular, spaced-apart, and downwardly-outwardly-slanting upper leg portions of said one-piece tubular frame.

16. The frame as defined in claim 14, wherein each end roller wheel assembly of said four end roller wheel assemblies of said movable mounting means has a centrally-disposed and laterally-oriented throughbore that extends centrally and laterally therethrough, and whose ends thereof expand into a pair of bearing recesses, in which bearings sit.

17. The frame as defined in claim 16, wherein each end roller wheel assembly of said four end roller wheel assemblies of said movable mounting means is rotatively mounted in a respective end guide housing of said pair of parallel, downwardly-extending, spaced-apart, inverted substantially U-shaped, and short end guide housings of each side of said pair of tubular, parallel, and spaced-apart sides of said rectangular-shaped base of said platform, by a pin that extends through a laterally-oriented throughbore in said respective end guide housing of said pair of parallel, downwardly-extending, spaced-apart, inverted substantially U-shaped, and short end guide housings of each side of said pair of tubular, parallel, and spaced-apart sides of said platform rectangular-shaped base of said platform, and through said centrally-disposed and laterally-oriented throughbore in said respective end roller wheel assembly of said four end roller wheel assemblies of said movable mounting means.

18. The frame as defined in claim 15, wherein each assembly of said pair of midpoint roller wheel assemblies of said preventing means has a centrally-disposed and laterally-oriented throughbore that extends centrally and laterally therethrough and whose ends expand into bearing recesses, in which bearings sit.

19. The frame as defined in claim 18, wherein said midpoint roller wheel assembly of said preventing means is rotatively mounted in said respective downwardly-extending, inverted substantially U-shaped, and long midpoint guide housing of said pair of tubular, parallel, and spaced-apart sides of said rectangular-shaped base of said platform, by a replaceable pin that extends laterally and replaceably through a laterally-oriented throughbore in said respective downwardly-extending, inverted substantially U-shaped, and long midpoint guide housing of said pair of tubular, parallel, and spaced-apart sides of said rectangular-shaped base of said platform, and through said centrally-disposed and laterally-oriented throughbore in said midpoint roller wheel assembly of said preventing means.

20. The frame as defined in claim 15, wherein said preventing means further includes a dampening assembly that accomplishes at least one of adjustably dampening the speed of motion of said platform on said one-piece tubular frame and locking said platform to said one-piece tubular frame so as to immobilize said platform in a specific position thereon.

21. The frame as defined in claim 20, wherein said dampening assembly of said preventing means includes a stationary brake shoe that is fixedly attached to an inner surface of a innermost leg of each said downwardly-extending, inverted substantially U-shaped, and long midpoint guide housing of said pair of tubular, parallel, and spaced-apart sides of said rectangular-shaped base of said platform, and which are frictionally engagable with an inner side of a respective track of said pair of tubular, parallel, spaced-apart, and substantially U-shaped tracks of said one-piece tubular frame.

22. The frame as defined in claim 21, wherein said dampening assembly of said preventing means further includes a movable brake shoe that is movably attached to an inner surface of an outermost leg of each said downwardly-extending, inverted substantially U-shaped, and long midpoint guide housing of said pair of tubular, parallel, and spaced-apart sides of said rectangular-shaped base of said platform, in opposing alignment to said stationary brake shoe of said dampening assembly of said preventing means, and which are frictionally engagable with an outer side of said respective track of said pair of tubular, parallel, spaced-apart, and substantially U-shaped tracks of said one-piece tubular frame.

23. The frame as defined in claim 22, wherein said movable brake shoe of said dampening assembly of said preventing means is fixedly attached to an end of a screw that extends laterally through, and threadably engages, a laterally-oriented throughbore in said outermost leg of each midpoint guide housing of said pair of parallel, downwardly-extending, spaced-apart, inverted substantially U-shaped, and long midpoint guide housings of said pair of tubular, parallel, and spaced-apart sides of said rectangular-shaped base of said platform.

24. The frame as defined in claim 23, wherein said dampening assembly of said preventing means further includes a knob that is fixedly attached to a protruding end of said screw of said dampening assembly of said preventing means, so that by turning said knob of said dampening assembly of said preventing means, said movable brake shoe of said dampening assembly of said preventing means contacts a respective track of said pair of tubular, parallel, spaced-apart, and substantially U-shaped concave-shaped tracks of said one-piece tubular frame and which is thereby forced against said stationary brake shoe of said dampening assembly of said preventing means until the desired amount of dampening is achieved.

25. A method of maintaining a chair level relative to a movable object that the chair is attached to, comprising the step of attaching the chair to a rolling chair frame which comprises:

a) a one-piece tubular frame being attachable to the movable object;

b) a platform being sidewardly movably mounted to said one-piece tubular frame and being adapted to replaceably receive the chair;

c) preventing means for preventing removal of said platform from said one-piece tubular frame, so that said platform cannot be unintentionally removed from said one-piece tubular frame; and d) movable mounting means for sidewardly movably mounting said platform to said one-piece tubular frame and for maintaining said platform level as the movable object moves.

* * * * *